US008827079B2

(12) United States Patent
Ravishankar et al.

(10) Patent No.: US 8,827,079 B2
(45) Date of Patent: Sep. 9, 2014

(54) PROCESS AND MAGNETIC REAGENT FOR THE REMOVAL OF IMPURITIES FROM MINERALS

(75) Inventors: Sathanjheri A. Ravishankar, Shelton, CT (US); Abdul K. Gorken, Stratford, CT (US)

(73) Assignee: Cytec Technology Corp., Wilmington, DE (US)

( * ) Notice: Subject to any disclaimer, the term of this patent is extended or adjusted under 35 U.S.C. 154(b) by 0 days.

(21) Appl. No.: 13/228,172

(22) Filed: Sep. 8, 2011

(65) Prior Publication Data

US 2012/0001115 A1 Jan. 5, 2012

Related U.S. Application Data

(60) Division of application No. 11/295,385, filed on Dec. 6, 2005, now Pat. No. 8,033,398, which is a continuation-in-part of application No. 11/175,490, filed on Jul. 6, 2005, now abandoned.

(51) Int. Cl.

| | |
|---|---|
| ***B03C 1/00*** | (2006.01) |
| ***H01F 1/44*** | (2006.01) |
| ***B03C 1/01*** | (2006.01) |
| *H01F 1/37* | (2006.01) |

(52) U.S. Cl.

CPC *H01F 1/445* (2013.01); *H01F 1/37* (2013.01); *B03C 1/01* (2013.01)

USPC ..... 209/8; 209/4; 252/62.51 R

(58) Field of Classification Search

USPC ..... 209/4, 8, 213–215; 252/62.51 R–62.51 C

See application file for complete search history.

(56) References Cited

U.S. PATENT DOCUMENTS

| | | | | |
|---|---|---|---|---|
| 2,287,440 | A | 6/1942 | McCleary et al. | |
| 3,627,678 | A | 12/1971 | Marston et al. | |
| 3,914,385 | A | 10/1975 | Slade | |
| 3,980,240 | A | 9/1976 | Nott | |
| 3,990,642 | A | 11/1976 | Nott | |
| 4,078,004 | A | 3/1978 | Schlaefer et al. | |
| 4,125,460 | A | 11/1978 | Nott et al. | |
| 4,406,865 | A | 9/1983 | Fuller | |
| 4,629,556 | A | 12/1986 | Yoon et al. | |
| 4,643,822 | A | 2/1987 | Parsonage | |
| 4,834,898 | A | 5/1989 | Hwang | |
| 4,871,446 | A | 10/1989 | Wang et al. | |
| 4,906,382 | A | 3/1990 | Hwang | |
| 4,929,343 | A | 5/1990 | Wang et al. | |
| 4,995,965 | A | 2/1991 | Mehaffey et al. | |
| 5,328,880 | A | 7/1994 | Lampert et al. | |
| 5,397,476 | A | 3/1995 | Bradbury et al. | |
| 5,720,873 | A | 2/1998 | Klingberg et al. | |
| 5,961,055 | A | 10/1999 | Lehitnen | |
| 6,143,065 | A | 11/2000 | Freeman et al. | |
| 6,200,377 | B1 | 3/2001 | Basilio et al. | |
| 6,269,952 | B1 | 8/2001 | Watt et al. | |
| 7,393,462 | B2 * | 7/2008 | Gorken et al. | 252/61 |

FOREIGN PATENT DOCUMENTS

| | | | |
|---|---|---|---|
| EP | 0522856 | B1 | 9/1994 |
| KR | 20070014821 | A | 2/2007 |
| WO | 00/51941 | A1 | 9/2000 |
| WO | 02/066168 | A1 | 8/2002 |

OTHER PUBLICATIONS

International Search Report and Written Opinion for PCT/US2007/086498.

Office Action of co-pending U.S. Appl. No. 11/968,850 mailed Feb. 18, 2010.

Office Action of co-pending U.S. Appl. No. 11/968,850 mailed Oct. 6, 2010.

International Search Report and Written Opinion for PCT/US2006/022694.

P. Tartaj et al., "The Preparation of Magnetic Nanoparticles for Applications in Biomedicine," J. Phys. D: Appl. Phys. 36, (2003) R182-R197.

* cited by examiner

*Primary Examiner* — Joseph C Rodriguez
*Assistant Examiner* — Kalyanavenkateshware Kumar
(74) *Attorney, Agent, or Firm* — Charles E. Bell

(57) ABSTRACT

A magnetic reagent contains magnetic microparticles and a compound of the formula (I) as defined herein. The magnetic reagent may be used in a magnetic separation process for the removal of impurities from mineral substrates.

15 Claims, No Drawings

PROCESS AND MAGNETIC REAGENT FOR THE REMOVAL OF IMPURITIES FROM MINERALS

CROSS-REFERENCE TO RELATED APPLICATIONS

This application is a divisional of U.S. application Ser. No. 11/295,385, filed Dec. 6, 2005 (now U.S. Pat. No. 8,033,398), which is a continuation-in-part of U.S. application Ser. No. 11/175,490, filed Jul. 6, 2005 (abandoned), each of which is hereby incorporated by reference in its entirety.

BACKGROUND

1. Field of the Invention

The present invention relates to the field of beneficiation of mineral substrates by removing undesired impurities. Specifically, the present invention relates to a magnetic reagent and a method of using it in a magnetic separation process to reduce the levels of the impurities in the mineral substrates.

2. Description of the Related Art

Beneficiation is a term used in the mining industry to refer to various processes for purifying mineral substrates (such as mineral ores) to obtain value minerals. Beneficiation typically involves separating the desired or "value" minerals from other less desirable or "non-value" mineral(s) that may be present in the mineral substrate. In many cases, the degree of separation obtained strongly influences the quality of the beneficiated product. For example, value minerals such as kaolin, talc, and calcium carbonate are used as pigments in a variety of end applications, e.g., coatings and fillers in paper, paint, plastic, ceramics, etc. In such applications, desirably higher levels of whiteness or brightness are typically associated with lower levels of impurities. However, value minerals often contain a variety of discoloring minerals such as titanium and iron phases. For example, kaolin typically contains anatase ($TiO_2$) and iron oxides, which detrimentally affect the brightness of kaolin. Also, minerals with relatively low impurity levels are often desired in other applications, such as in the electronics, optics and biomedical fields.

Some mineral separation processes involve the use of magnetic reagents and strong magnetic fields. PCT Publication WO 02/066168 discloses surface-functionalized magnetic particles that are said to be useful as magnetic reagents for mineral beneficiation. The magnetic particles are said to be at least comparable in size with the mineral particles, and thus it is apparent that the amount of material present on the surfaces of the magnetic particles is only a small part of the magnetic reagent. U.S. Pat. Nos. 4,834,898 and 4,906,382 disclose magnetizing reagents that are said to comprise water that contains particles of a magnetic material, each of which has a two layer surfactant coating including an inner layer and an outer layer. The inner and outer surfactant layers on the magnetic particles are said to be monomolecular, and thus it is apparent that the amounts of surfactants in the magnetic reagent are very small as compared to the amounts of magnetic particles.

SUMMARY

An embodiment provides a process for the beneficiation of a mineral substrate by magnetic separation, comprising:

intermixing a mineral substrate and a magnetic reagent to form a mixture; and applying a magnetic field to the mixture to thereby separate a value mineral from a non-value mineral;

wherein the magnetic reagent comprises a plurality of magnetite microparticles and a compound of the formula (I), $$R—(CONH—O—X)_n \quad (I)$$

where the compound of the formula (I) has a molecular weight of about 2,000 or less; n is an integer in the range of 1 to 3; each X is individually selected from the group consisting of H, M and $NR'_4$; M is a metal ion; R comprises from about 1 to about 50 carbons; and each R' is individually selected from the group consisting of H, $C_1$-$C_{10}$ alkyl, $C_6$-$C_{10}$ aryl, and $C_7$-$C_{10}$ aralkyl;

where the plurality of magnetite microparticles have an average diameter of less than 50 microns; and where the plurality of magnetite microparticles and the compound of the formula (I) are present in the magnetic reagent in a weight ratio of magnetite microparticles: compound of the formula (I) in the range of about 10:1 to about 1:10.

Another embodiment provides a magnetic reagent for the beneficiation of a mineral substrate, comprising:

a plurality of magnetite microparticles having an average diameter of less than 50 microns; and a compound of the formula (I), $$R—(CONH—O—X)_n \quad (I)$$

where the compound of the formula (I) has a molecular weight of about 2,000 or less; n is an integer in the range of 1 to 3; each X is individually selected from the group consisting of H, M and $NR'_4$; M is a metal ion; R comprises from about 1 to about 50 carbons; and each R' is individually selected from the group consisting of H, $C_1$-$C_{10}$ alkyl, $C_6$-$C_{10}$ aryl, and $C_7$-$C_{10}$ aralkyl;

the plurality of magnetite microparticles and the compound of the formula (I) being present in the magnetic reagent in a weight ratio of magnetite microparticles: compound of the formula (I) in the range of about 10:1 to about 1:10.

These and other embodiments are described in greater detail below.

DETAILED DESCRIPTION OF THE PREFERRED EMBODIMENTS

Various embodiments provide magnetic reagents and methods of using them for the beneficiation of mineral substrates. In an embodiment, the magnetic reagent comprises a plurality of magnetite microparticles having an average diameter of less than 50 microns and a compound of the formula (I):

$$R—(CONH—O—X)_n \quad (I)$$

Various examples of preferred compounds of the formula (I) are described below. The plurality of magnetite microparticles and the compound of the formula (I) are preferably present in the magnetic reagent in a weight ratio of magnetite microparticles: compound of the formula (I) in the range of about 10:1 to about 1:10.

The magnetite microparticles in the magnetic reagent may be obtained from commercial sources and/or made by techniques known to those skilled in the art (see, e.g., P. Tartaj et al., J. Phys. D: Appl. Phys. 36, (2003) R182-R197 and references contained therein). Those skilled in the art will understand that so-called ferroso-ferric oxide particles (typically prepared by a process of coprecipitaion of iron (II) and iron (III) salts) are examples of magnetite microparticles.

Preferred magnetite microparticles have an average diameter of less than 50 microns. It has been found that improved beneficiation is often observed as the particle size of magnetite microparticles is decreased. Thus, it may be desirable in certain applications to use magnetite microparticles with the smallest practical particle size. Often, good results may be obtained using magnetite microparticles having an average diameter of less than 10 microns. Preferably the average diameter is less than 1 micron. The plurality of magnetite microparticles in the magnetic reagent may have a unimodal or polymodal (e.g., bimodal) particle size distribution.

In any given situation, the size of the magnetite microparticles may be selected on the basis of various practical considerations, such as cost, throughput, the mineral substrate to be treated and the degree of beneficiation desired. Thus, for a example, in some applications a relatively low degree of beneficiation may be obtained using a magnetic reagent that comprises magnetite microparticles having an average particle size between about 1 and 50 microns. However, when a high degree of beneficiation is desired, smaller magnetite microparticles are often preferred. In some applications, the magnetic reagent preferably comprises magnetite microparticles having an average diameter of about 1.0 micron or less, more preferably about 0.2 micron (200 nanometers) or less. Use of a magnetic reagent that comprises magnetite microparticles having an average diameter of less than 0.02 micron (20 nanometers) is most preferred, particularly when a high degree of beneficiation is required. These extremely small microparticles may be referred to as nanoparticles.

The sizes of magnetite microparticles may be determined by measuring their surface areas using BET $N_2$ adsorption techniques. For example, Table 1 below illustrates correlations between magnetite microparticle diameters (in units of nanometers, m) and surface areas (in units of square meters per gram, $m^2/g$) as determined by BET $N_2$ adsorption techniques known to those skilled in the art.

TABLE 1

| Diameter (nm) | Surface Area ($m^2/g$) |
|---|---|
| 4 | 300 |
| 8 | 150 |
| 20 | 60 |
| 200 | 5 |
| 10,000 | 0.1 |

Preferred magnetite microparticles have a magnetic response in the range from about 25 emu/g to about 300 emu/g. The conductivity of a magnetic reagent may vary from about 0 to about 50 milliSiemans/cm but is preferably less than about 2 milliSiemens/cm. Iron oxide in the magnetic microparticles may comprise various oxides over a range of formulaic representations from FeO to $Fe_2O_3$, which may be generally represented as $Fe_xO_y$ where x and y may each individually vary from one to four. One or more water molecules may be associated with each iron atom. For example, each iron atom may be associated with from about one to about 10 water molecules, more preferably from about one to about 7 water molecules, most preferably from about one to about 4 water molecules. Optionally, the iron oxide may comprise hydroxides of iron, e.g., one or more oxygen atoms of $Fe_xO_y$ may be replaced by hydroxyl (OH) group(s).

The magnetic reagent also comprises a compound of the formula (I):

$$R—(CONH—O—X)_n \quad (I)$$

Preferably, the compound of the formula (I) has a molecular weight of about 2,000 or less; n is an integer in the range of 1 to 3; each X is individually selected from the group consisting of H, M and $NR'_4$; M is a metal ion (e.g., lithium, sodium, potassium, magnesium, or calcium, preferably sodium or potassium); R comprises from about 1 to about 50 carbons; and each R' is individually selected from the group consisting of H, $C_1$-$C_{10}$ alkyl, $C_6$-$C_{10}$ aryl, and $C_7$-$C_{10}$ aralkyl. Thus, R may comprise various organic chemical groups, including without limitation branched and unbranched, substituted and unsubstituted versions of the following: alkyl (e.g., $C_1$-$C_{20}$ alkyl, preferably $C_5$-$C_{12}$ alkyl), cycloalkyl, bicycloalkyl, alkylene oxide, (e.g., $((CH_2)_n—O—)_m$, where n and m are each individually in the range of about 1 to about 6), polycycloalkyl, alkenyl, cycloalkenyl, bicycloalkenyl, polycycloalkenyl, alkynyl, aryl (e.g., $C_6$-$C_{20}$ aryl, preferably $C_6$-$C_{12}$ aryl), bicycloaryl, polycycloaryl, heteroaryl, and aralkyl (e.g., $C_7$-$C_{20}$ aralkyl, preferably $C_7$-$C_{12}$ aralkyl). Preferably, R=$C_1$-$C_{20}$ alkyl, $C_6$-$C_{20}$ aryl, or $C_7$-$C_{20}$ aralkyl. More preferably, R=$C_5$-$C_{12}$ alkyl, $C_6$-$C_{12}$ aryl, or $C_7$-$C_{12}$ aralkyl. Examples of suitable R groups include butyl, pentyl, hexyl, octyl, dodecyl, lauryl, 2-ethylhexyl, oleyl, eicosyl, phenyl, tolyl, naphthyl and hexylphenyl.

Examples of preferred compounds of the formula (I) include those in which n=1 and in which X and R are as follows: X=K, R=butyl; X=K, R=pentyl; X=K, R=octyl; X=K, R=decyl; X=K, R=lauryl; X=K, R=2-ethylhexyl; X=K, R=oleyl; X=K, R=phenyl; X=K, R=naphthyl; X=K, R=hexylphenyl; X=Na, R=butyl; X=Na, R=pentyl; X=Na, R=octyl; X=Na, R=decyl; X=Na, R=lauryl; X=Na, R=2-ethylhexyl; X=Na, R=oleyl; X=Na, R=phenyl; X=Na, R=naphthyl; and X=Na, R=hexylphenyl. It will be understood compounds of the formula (I) are salts of the corresponding acids, and that magnetic reagents comprising compounds of the formula (I) may also comprise the corresponding acids. The salts and acids may be interconverted by methods known to those skilled in the art. Preferred compounds of the formula (I) may be prepared by the methods described in U.S. Pat. Nos. 4,629,556; 4,871,466; and 4,929,343, all of which are hereby incorporated by reference in their entireties and particularly for the purpose of describing examples of compounds of the formula (I) and methods for making them. Preferred compounds of the formula (I) may be obtained commercially from Cytec Industries, Inc., West Paterson, N.J., under the tradenames CYTEC S6493, CYTEC S6494, CYTEC S8881 and CYTEC S9849 MINING REAGENTS®. The magnetic reagent may comprise a mixture of compounds of the formula (I).

The magnetic reagent comprising magnetite microparticles and a compound of the formula (I) may optionally comprise additional ingredients. For example, in an embodiment, a magnetic reagent comprises magnetite microparticles, a compound of the formula (I), and a liquid such an alcohol and/or water. In another embodiment, a magnetic reagent comprises magnetite microparticles, a compound of the formula (I), and a dispersant. In another embodiment, a magnetic reagent comprises magnetite microparticles, a compound of the formula (I), a liquid such as an alcohol and/or water, and a dispersant. The amounts of magnetite microparticles, compound of the formula (I), optional liquid and optional dispersant may vary over a broad range. For example, in an magnetic reagent embodiment, the amount of magnetite microparticles is in the range of about 1% to about 99%, the amount of compound of the formula (I) (or mixture thereof) is in the range of from about 1% to about 99%, the amount of liquid (e.g., water, oil (e.g., mineral oil, synthetic oil, vegetable oil), and/or alcohol) is in the range of from zero to about 95%, and the amount of dispersant is in the range of from zero to about 10%, all of the foregoing amounts being weight percent based on total weight of the magnetic reagent. The plurality of magnetite microparticles and the compound of the formula (I) are preferably present in the magnetic reagent in a weight ratio of magnetite microparticles: compound of the formula (I) in the range of about 10:1 to about 1:10, more preferably in the range of about 8:1 to about 1:8, even more preferably in the range of about 5:1 to about 1:5. Magnetic reagents that comprise a liquid (such as water, oil and/or alcohol) may be formulated in various ways, e.g., the magnetic particles may be suspended (e.g., colloidal suspension), dispersed and/or slurried in the liquid, and/or the compound of the formula (I) may be suspended, dispersed, slurried and/or dissolved in the liquid. In an embodiment, the magnetic reagent is provided in the form of a substantially dry powder.

The presence of a dispersant in the magnetic reagent may provide various benefits. For example, the dispersant may facilitate dispersal of the magnetic microparticles and/or compound of the formula (I) in a magnetic reagent that contains a liquid, and/or the dispersant may facilitate dispersal of mineral particles and/or impurities of the mineral substrate with which the magnetic reagent is intermixed. The dispersant may be an organic dispersant such as a water-soluble polymer or mixture of such polymers, an inorganic dispersant such as a silicate, phosphate or mixture thereof, or a mixture of organic and inorganic dispersants. An example of a suitable organic dispersant is a water-soluble or water-dispersible polymer that comprises a least one moiety selected from the group consisting of carboxyl and sulfonate. Polyacrylic acid and Na-polyacrylate are examples of water-soluble or water-dispersible polymers that comprise a carboxyl group. Poly(2-acrylamido-2-methyl-1-propanesulfonate), also known as poly(AAMPS), is an example of a water-soluble or water-dispersible polymer that comprises a sulfonate group. Other suitable organic dispersants include natural and synthetic gums and resins such as guar, hydroxyethylcellulose, and carboxymethylcellulose. The amount of dispersant is preferably in the range from zero to about 15 pounds of dispersant per ton of magnetic reagent.

In another embodiment, the magnetic reagent is provided in a liquid form, preferably a dispersion of the magnetite microparticles and a compound of the formula (I) in a liquid. For economy, the liquid is preferably water, although the liquid form may comprise other liquids such as oil and/or alcohol, in addition to or instead of the water. The liquid is preferably present in an amount that makes the liquid form flowable, e.g., from about 25% to about 95% of liquid by weight based on total weight of the dispersion, more preferably from about 35% to about 75%, same basis. Optionally a dispersant may be used to provide for a uniform and stable dispersion of the components in the liquid. Examples of preferred dispersants include the inorganic and organic dispersants described above. The amount of dispersant in the dispersion is preferably an amount that is effective to provide a stable dispersion, e.g., from about 1% to about 10% by weight based on the total weight of the dispersion.

The magnetic reagent comprising magnetite microparticles and a compound of the formula (I) may be made in various ways. For example, in an embodiment, the magnetic reagent is in the form of a substantially dry mixture of the magnetite microparticles and the compound of the formula (I), optionally further comprising a dispersant. Such a substantially dry mixture may be formed by, e.g., intermixing the components (e.g., dry magnetite microparticles, dry compound of the formula (I), and optional dispersant), or by suspending, dispersing, slurrying or dissolving the components in a liquid, optionally with heating and/or stirring, then removing the liquid to form a substantially dry mixture. In another embodiment, the magnetic reagent is in the form of a flowable mixture comprising the magnetite microparticles, the compound of the formula (I), a liquid (e.g., water and/or alcohol), and optionally further comprising a dispersant. As indicated above, the magnetic particles in such a flowable mixture may be suspended (e.g., colloidal suspension), dispersed and/or slurried in the liquid, and/or the compound of the formula (I) may be suspended, dispersed, slurried and/or dissolved in the liquid. Such a flowable mixture may be formed by intermixing the components (in any order), preferably with stirring, optionally with heating. Various formulations may be prepared by employing routine experimentation.

Another embodiment provides a process for the beneficiation of a mineral substrate by magnetic separation, comprising intermixing a mineral substrate and a magnetic reagent to form a mixture; and applying a magnetic field to the mixture to thereby separate a value mineral from a non-value mineral. The magnetic reagent used in the process may be a magnetic reagent as described above. Preferably, the magnetic reagent comprises a plurality of magnetite microparticles and a compound of the formula (I), where the plurality of magnetite microparticles have an average diameter of less than 50 microns; and where the plurality of magnetite microparticles and the compound of the formula (I) are present in the magnetic reagent in a weight ratio of magnetite microparticles: compound of the formula (I) in the range of about 10:1 to about 1:10.

The mineral substrate that is intermixed with the magnetic reagent may be a substrate that contains both "value" minerals and "non-value" minerals. In this context, the term "value" mineral refers to the mineral or minerals that are the primary object of the beneficiation process, e.g., the mineral from which it is desirable to remove impurities. The term "non-value" mineral refers to the mineral or minerals for which removal from the value mineral is desired, e.g., impurities in the value mineral. Typically, the amount of value mineral in the mineral substrate is substantially larger than the amount of non-value mineral. The terms "value" mineral and "non-value" mineral are terms of art that do not necessarily indicate the relative economic values of the constituents of the mineral substrate. For example, it may be desirable to beneficiate a mineral substrate that comprises about 97% kaolin, 2% $TiO_2$ and about 1% of other impurities, for the purpose of obtaining beneficiated kaolin that contains less than 2% $TiO_2$. Thus, in this example, the kaolin is considered a value mineral and the $TiO_2$ and other impurities are considered non-value minerals, even though the $TiO_2$ may have value in an economic sense. A non-value mineral is not necessarily discarded, and may be considered a value mineral in a subsequent process e.g., in which it is recovered and/or purified. Examples of mineral substrates include metal oxides, hydroxides, carbonates, silicates, aluminosilicates, sulfides, and phosphates. Preferred mineral substrates include those that comprise at least one selected from the group consisting of kaolin, calcium carbonate, talc, phosphate and iron oxide. Mineral substrates may be formed in various ways. For example, a mineral substrate may be an ore body that has been ground to a fine size (often in an aqueous medium) in order to liberate the constituent minerals. Such a mineral substrate may comprise a dispersion or pulp of mineral particles that may then be treated with a magnetic reagent.

The mineral substrate and the magnetic reagent may be intermixed in various ways, e.g., in a single stage, in multiple stages, sequentially, reverse order, simultaneously, or in various combinations thereof. For example, in an embodiment, the magnetic reagent is formed separately by intermixing the various components (e.g., magnetic microparticles, compound of the formula (I), optional ingredients such as water, dispersant, etc.) to form a pre-mix, then intermixed with the mineral substrate. In another embodiment, the magnetic reagent is formed in situ by separately intermixing the components of the magnetic reagent with the mineral substrate. For example, the magnetite microparticles may be added to the mineral substrate, followed by the addition of the compound of the formula (I), or the magnetic microparticles and the compound of the formula (I) may be added simultaneously (without first forming a premix) to the mineral substrate. Various modes of addition have been found to be effective.

The amount of magnetic reagent intermixed with the mineral substrate is preferably an amount that is effective to beneficiate the mineral substrate to thereby separate a value mineral from a non-value mineral upon application of a magnetic field. Since the amounts of the magnetite microparticles and the compound of the formula (I) in the magnetic reagent may vary depending on, e.g., the amount of water (if any) in the magnetic reagent and/or whether the components are added separately or as a pre-mix, it many cases it is preferable to determine the amount of magnetic reagent to be intermixed with the mineral substrate on the basis of the amounts of the individual components (e.g., the magnetite microparticles and the compound of the formula (I)) in the magnetic reagent. Thus, the magnetic reagent is preferably intermixed with mineral substrate in an amount that provides a dose of the compound of the formula (I) in the range of from 0.1 kilograms per ton (Kg/T) to about 10 Kg/T based on the mineral substrate, more preferably in the range of about 0.25 Kg/T to about 6 Kg/T. The magnetic reagent is preferably intermixed with mineral substrate in an amount that provides a dose of the magnetite microparticles in the range of from about 0.005 Kg/T to about 10 Kg/T based on mineral substrate, more preferably in the range of from about 0.25 Kg/T to about 6 Kg/T.

Beneficiation of the mixture formed by intermixing the mineral substrate and the magnetic reagent may be conducted by applying a magnetic field to the mixture to thereby separate the value mineral(s) from the non-value mineral(s). The mixture (comprising the mineral substrate and the magnetic reagent) may be referred to as a "slip" herein. The magnetic field may be applied to the slip in various ways. For example, in an embodiment, separation is accomplished by passing the slip through a high gradient magnetic separator. Various high gradient magnetic separators are those that exhibit a magnetic flux greater than or equal to about 2.2, are known to those skilled in the art and may be obtained from commercial sources. An example of a preferred high gradient magnetic separator is the apparatus sold under the tradename Carpco Cryofilter® (Outokumpu Technologies, Jacksonville, Fla.). High gradient magnetic separation is a process generally known in the art, and is described, e.g., in U.S. Pat. Nos. 4,125,460; 4,078,004 and 3,627,678. In general, the separation involves applying a strong magnetic field to the slip while passing the slip through a steel matrix having an open structure (e.g. stainless steel wool, stainless steel balls, nails, tacks, etc.). The retention time in the magnet matrix and the magnet cycle may be varied as desired, according to standard methods.

As another example, in an embodiment, separation is accomplished by passing the slip through a low intensity magnetic separator. Various low intensity magnetic separators are known to those skilled in the art and may be obtained from commercial sources. An example of a preferred low intensity magnetic separator is an apparatus which exhibits a magnetic flux up to about 0.7 Tesla, preferably from about 0.01 Tesla to about 6 Tesla, more preferably from about 0.1 Tesla to about 2.2 Tesla, even more preferably from about 0.1 to about 1 Tesla and most preferably from about 0.1 Tesla to about 0.7 Tesla. Low gradient magnetic separation is a process generally known in the art, and is described, e.g., in U.S. Pat. Nos. 5,961,055 and 6,269,952. In general, the separation involves applying a weak magnetic field (from 0.01 Tesla to 0.7 Tesla) to the slip while passing the slip through a steel matrix having an open structure. Generally, low intensity magnetic separators are described as those used in removing tramp iron, e.g., stainless steel wool, stainless steel balls, nails, tacks, etc. that are strongly ferromagnetic in nature. As with the high gradient magnetic separation, the retention time for low intensity separation in the magnet matrix and the magnet cycle may be varied as desired, according to standard methods.

The compound of the formula (I) is preferably selected to achieve a degree of separation between the value mineral and the non-value mineral that is greater than a degree of separation achieved using an oleic acid compound in place of the compound of the formula (I). More preferably, the degree of separation is at least about 10% greater, even more preferably at least about 25% greater, even more preferably at least about 50% greater, than a degree of separation achieved using an oleic acid compound in place of the compound of the formula (I). In this context, the term oleic acid compound includes acid and salt forms of oleic acid. Degree of separation is expressed as a percentage calculated as follows: $100\times((W_1-W_2)/W_1)$, where $W_1$=weight fraction of impurities in the mineral substrate before separation and $W_2$=weight fraction of impurities in the mineral substrate after separation.

Preferably, the slip is conditioned prior to applying the magnetic field. "Conditioning" is a term used in the art to refer to various processes for imparting high shear to a mineral substrate in an aqueous environment. Any type of rotor device (e.g., rotor-stator type mill) capable of imparting high shear to the mixture of the mineral substrate and the magnetic reagent may be used. The high shear may be achieved using a rotor device operating at a rotor blade tip speed of at least about 20 feet per second, and usually in a range of about 50 to about 200 feet per second. A preferred rotor device is a mill capable of achieving a rotor tip speed of about 125 to about 150 feet per second. Appropriate rotor devices include rotor-stator type mills, e.g., rotor-stator mills manufactured by Kady International (Scarborough, Ma.) (herein referred to as a "Kady mill") and rotor-stator mills manufactured by Impex (Milledgeville, Ga.) (herein referred to as an "Impex mill"); blade-type high shear mills, such as a Cowles blade-type mills (Morehouse Industries, Inc., Fullerton, Calif.); and high shear media mills, such as sand grinders. The slip is preferably conditioned for a time sufficient to enhance the subsequent magnetic separation step, without unduly reducing the quality of the resulting value mineral. Conditioning times may vary, depending in many cases on the nature of the device used to impart the shear. For example, for conditioning with a Kady mill, the slip may be conditioned for about 1 minute to about 10 minutes, and a typical range may be from about 2 minutes to about 8 minutes, in many cases from about 3 minutes to about 6 minutes. These typical times may be applied to other shearing devices based upon the relative shear imparted by those devices as compared to the Kady mill, as understood by those of skill in the art. The conditioned slip containing the magnetite microparticles and the compound of the formula (I) may then be subjected to high gradient magnetic separation as described above. The high gradient magnetic separation is preferably performed at a time from about immediately after conditioning to within about 1 day after conditioning, within about 2 days after conditioning, within about 3 days after conditioning, or within about 4 days after conditioning.

In a preferred embodiment, the mineral substrate comprises kaolin, which may also be referred to herein as kaolin clay or simply as clay. The kaolin may be any in need of beneficiation, e.g., kaolin comprising one or more non-value minerals that contain impurities such as iron, titanium, and/or manganese, or any other mineral (e.g., a non-value mineral or impurity) that may detract from the brightness of the kaolin. A preferred embodiment provides an improved beneficiation process for making high brightness kaolin clay. For example, a preferred kaolin beneficiation process comprises intermixing a kaolin substrate with a magnetic reagent to form a slip as described above, dispersing the slip at a pH of about 7.0 to about 10.0, conditioning the resulting dispersed slip, and applying a high gradient magnetic field to the resulting conditioned slip to thereby separate a brightened kaolin from undesired impurities. Various portions of the following description are directed to embodiments in which the mineral substrate comprises kaolin clay (value mineral) and $TiO_2$ (non-value mineral or impurity). However, those skilled in the art will recognize that those portions of the following description are included for the purpose of illustration, and that various aspects of those portions may be selected and/or adapted for use in other processes involving the beneficiation of other mineral substrates.

In a preferred embodiment, the mineral substrate may comprise any kaolin clay, e.g., crude, processed or partially processed, for which an increase in brightness is desired. For example, the kaolin clay may be a crude kaolin clay, e.g., it may comprise gray clay, cream clay, or a combination of clays. Alternatively, the crude clay may comprise Australian or Brazilian kaolin crude or English kaolin crude. The crude kaolin may contain organic matter (i.e., grey crude) or it may be a crude substantially lacking organic matter (i.e., cream, tan, brown, or red crude's). As discussed below, the selection of starting crude may guide the choice of additional processing steps that may be carried out to achieve the further increase the brightness of the kaolin product. For example, in an embodiment one may optionally additionally employ ozone treatment prior to addition of the magnetic reagent or after the magnetic separation, particularly when the starting crude material is a grey crude.

The kaolin may be a fractionated clay, which includes any clay whose particle size distribution has been modified or aggregated, such as by mechanical methods or by alternative methods such as chemical fractionation or aggregation, which methods are all known in the art. Fractionation can be performed at any desired step in the process, such as prior to intermixing with the magnetic reagent, prior to conditioning, prior to magnetic separation, after magnetic separation, or after any of the standard processing steps performed after magnetic separation. The clay may be a degritted clay, e.g., such that it meets +325 mesh residue specifications for paper coating applications. It is preferred that the crude clay be degritted for practical purposes of preventing unnecessary wear on the mill used for the conditioning step.

The mineral substrate may comprise a blunged crude clay. If the clay is blunged prior to magnetic separation, it is preferable to blunge the clay with a weak or a strong dispersant, and at an alkaline pH, preferably with sodium silicate or silicate hydrosol. Blunging carried out prior to intermixing the clay with the magnetic reagent is preferably performed at an alkaline pH, preferably a pH in the range of about 7.0 to about 11.0, more preferably at a pH in the range of about 8.0 to about 10.0, even more preferably at a pH in the range of about 8.0 to about 9.5. The blunging may be performed at a solids range of from greater than 0 to about 70% solids, or from about 20% solids to about 70% solids; a preferred solids range may be about 30% solids to about 70% solids, about 20% solids to about 65% solids, about 20% solids to about 60% solids, about 30% solids to about 60% solids, about 40% solids to about 60% solids, about 20% solids to about 45% solids, about 35% solids to about 55%, about 39% solids to about 44% solids.

An aqueous kaolin clay slurry preferably comprises a dispersant, which may be a weak or strong dispersant. A "weak dispersant" is one that does not significantly compete for adsorption on the surface of the $TiO_2$ impurity relative to the adsorption of the magnet enhancer reagent, whereas a "strong dispersant" is one that dominates adsorption on the surface of the $TiO_2$ impurity. Sodium silicate is a non-limiting example of a weak dispersant. Additionally, at any time prior to magnetic separation, a strong dispersant may be added to the mineral substrate and/or slip. Non-limiting examples of strong dispersants include sodium polyacrylate, sodium hexametaphosphate ("Calgon," Calgon Corp., Pittsburgh, Pa.) Cyanamer P-80, Cyanamer P-70, and Cyanamer P-35 (Cytec Industries Inc. NJ). Examples of sodium polyacrylate include Colloid 211 (Rhone-Poulenc, Marietta, Ga.).

The strong dispersant may be present in the mineral substrate or slip, on an active basis, in an amount in the range of from zero lb/ton kaolin (kaolin weight on a dry basis) to about 1.0 Kg/ton kaolin (kaolin weight on a dry basis), for example, at from 0.1 Kg/ton kaolin to 0.7 Kg/ton kaolin on a dry basis. The amount may be varied according to specific characteristics of the clay, by methods known to those skilled in the art. A dispersant or dispersant may be added at various stages to facilitate processing of the kaolin prior to magnetic separation. For example, the dispersant may be added before, during or after blunging, or before, during or after addition of the magnetite reagent, or any combination thereof, e.g., the dispersant(s) may be added before blunging and optionally before and/or after addition of magnetite reagent.

At any point prior to the application of the magnetic field, the pH of the mineral substrate or slip may be adjusted, e.g., for kaolin clay, preferably to a pH in the range of about 7.0 to about 11.0 as measured by the in-processing pH method. The pH may be, e.g., about 8.0 to about 9.0, about 8.5 to about 9.0, and a preferred pH range may be about 8.0 to about 9.5, all as measured by the in-processing pH method. To raise pH, one can use any alkali such as sodium hydroxide, or a blend of sodium silicate and sodium hydroxide. Alternatively, the pH can be adjusted using sodium silicate or soda ash.

Prior to application of the magnetic field, the solids level of a flowable slip such as a slurry may be adjusted to the desired concentration which is usually in the range of greater than 0% to about 70%, more preferably from about 20% to about 60%, and most preferably from about 20% to about 45%, by weight based on total weight.

After magnetic separation, the resulting beneficiated product may be subjected to additional processing steps in order to provide the separated value mineral(s) and non-value mineral (s) in the form desired. Thus, any desired processing steps may be performed on the resultant beneficiated product. For example, the beneficiated product may be flocculated, e.g., to produce a flocculated improved brightness kaolin clay product or a flocculated reduced-impurities clay product. Alternatively or additionally, the beneficiated product may be leached, e.g., to produce a leached improved brightness kaolin clay product or a leached reduced-impurities clay product. The beneficiated product can also be ozonated to remove the organic matter. The reject or the magnetic portion obtained after magnetic separation may be reused as a reagent on a "as is" basis or in combination with the fresh magnetic reagent, e.g., to treat a fresh slip of kaolin for impurities removal.

The beneficiation process may further comprise dewatering the fractionated, flocculated, and/or leached improved brightness kaolin clay or reduced-impurities clay. Dewatering includes any amount of water removal, so that the resultant improved brightness kaolin clay or reduced-impurities clay may be a slurry, a partially dried clay, or a fully dried clay, as is known in the art.

Some examples of process variants for making an improved brightness kaolin clay or for removing iron- and/or titania-containing impurities from any clay containing such impurities include the following:

1) Blunge—degrit—add magnetite microparticles-then compound of formula (I) —condition—magnetic separation—non-magnetic portion—further processing 2) Blunge—degrit—add magnetite microparticles—then compound of formula (I) —condition—magnetic separation—magnetic portion—add to new slip—condition—magnetic separation—non-magnetic portion—further processing 3) Blunge—degrit—fractionate—add magnetite microparticles—then compound of formula (I) —condition—magnetic separation—further processing 4) Blunge—degrit—fractionate—add magnetite microparticles—then compound of formula (I) —condition—magnetic separation—add to new slip—condition—magnetic separation—non-magnetic portion—further processing.

5) Blunge—degrit—ozone treat—add magnetite microparticles—then compound of formula (I) —condition—magnetic separation—further processing.

6) Blunge—degrit—ozone treat—add magnetite microparticles—then compound of formula (I) —condition—magnetic separation—add to new slip—condition—magnetic separation—non-magnetic portion—further processing.

7) Blunge—degrit—ozone treat—fractionate—add magnetite microparticles—then compound of formula (I) —condition—magnetic separation—further processing.

8) Blunge—degrit—ozone treat—fractionate—add magnetite microparticles—then compound of formula (I) —condition—magnetic separation—add to new slip—condition—magnetic separation—non-magnetic portion—further processing.

9) Blunge—degrit—add magnetite microparticles—then compound of formula (I) —condition—magnetic separation—fractionate—delaminate—further processing.

10) Blunge—degrit—fractionate—add magnetite microparticles—then compound of formula (I) —condition—magnetic separation—collect the magnetic portion—add to new slip—add magnetite microparticles—then compound of formula (I) —condition—magnetic separation—collect non mag portion—further processing.

11) Blunge—degrit—Screen—add magnetite microparticles—then compound of formula (I) —condition—magnetic separation—collect the magnetic portion—add to new slip—add magnetite microparticles—then compound of formula (I) —condition—magnetic separation—collect non mag portion—fractionate—further processing.

12) Blunge—degrit—Screen—add magnetite microparticles—then compound of formula (I) —condition—fractionate by centrifugation—collect the fines—further processing.

13) Blunge—degrit—Screen—add magnetite microparticles—then compound of formula (I) —condition—fractionate by centrifugation—collect the coarse—magnetic separation—non-magnetic portion—further processing.

14) Blunge—degrit—Screen—add magnetite microparticles—then compound of formula (I) —condition—fractionate by centrifugation—collect fines—add magnetite microparticles—then add compound of formula (I) —condition—magnetic separation—further processing.

In foregoing examples of process variants, further processing may include any one or more of the following: no treatment, spray drying, fractionating, flocculating, leaching, dewatering.

EXAMPLES 1-7

Crude kaolin characterized as "coarse white" or medium coarse white" or a blend thereof from middle Georgia with a $TiO_2$ level of 1.8% (by weight) is blunged in water to about 40-45% solids at pH=8 using a dispersant blend of 5-6 lbs/Ton of sodium silicate to 1-2 part sodium hydroxide. After degritting this crude through a Dorr-Cone, sandbox and 100 mesh screen, the crude is fractionated on a Bird Machine Co. (South Walpole, Mass.) centrifuge to obtain a fine fraction of 90% less than two microns as measured on a Sedigraph 5100 (Micromeritics, Norcross, Ga.). No further work is done on the coarse fraction. The fines are at 30.3% solids.

About one Kg of the fines fraction on dry basis is weighed out and transferred to a Kady conditioning mill. The slurry is agitated at low speed at 10-20 Hz frequency in the Kady mill and dosed with 3 Kg/T of a sodium silicate dispersant (Star Brand Silicate) on an as-received basis followed by adding 3 Kg/T of 10% NaOH solution to adjust the pH to 9.2. To the pH-adjusted slurry, 5 kg/Ton of magnetite microparticles having a BET surface area of 82.0 $m^2/g$ (average diameter 14 nm) are added, followed by the addition of 1 Kg/T (on an active basis) of various chemical additives as shown in Table 2.

After the additives are mixed in for about 30 seconds to 1 minute, the slip is conditioned through a Kady mill for 6 minutes at 60 Hz frequency from 38 to 57 HP-hours/ton. The conditioned slip is then reduced to 25% solids and processed through a high gradient magnetic separator (Cryofilter, Outokumpu Technologies, Jacksonville, Fla.) filled with a nominal matrix (60 μm. in diameter) at a feed rate corresponding to 10 T/Hr under a 2.5 Tesla magnetic field. The slip is fed through the magnet for 1 minute and 25 seconds followed by a washing cycle. The product is collected, oven dried and the $TiO_2$ level in the beneficiated kaolin is measured (% $TiO_2$).

In Table 2, AP-Aero®6493 is a commercially available (Cytec Industries Inc.) collector composition that contains a compound of the formula I. Hamphosil O is a commercially available (Hampshire Chemical Corp.) oleoyl sarcosine surfactant. Ethox ML5 is a commercially available (Ethox Chemicals LLC) ethoxylated alcohol surfactant. HM-62 is a commercially available (Penreco) petroleum sulfonate surfactant. AP-3000C is a commercially available (Cytec Industries Inc.) primary amine surfactant.

Table 2 shows that the highest degree of separation (68%) is obtained in Example 2 using magnetite microparticles and a compound of the formula (I).

TABLE 2

| No. | Chemical Additive | Additive Type | Additive Dose As is (Active) Kg/T | % $TiO_2$ | Degree of Separation |
|---|---|---|---|---|---|
| 1C | No magnetite microparticles | None | 0 | 1.13 | 37% |

TABLE 2-continued

| No. | Chemical Additive | Additive Type | Additive Dose As is (Active) Kg/T | % $TiO_2$ | Degree of Separation |
|---|---|---|---|---|---|
| | No additive | | | | |
| 2 | Aero ®-6493 | Compound of formula (I) | 3.33 (1.0) | 0.58 | 68% |
| 3C | AP-3000C | Amine surfactant | 2.00 (1.0) | 0.76 | 58% |
| 4C | HM-62 | Sulfonate surfactant | 1.00 (1.0) | 0.89 | 51% |
| 5C | Hemphosil-O | Sarcocinate surfactant | 2.00 (1.0) | 1.11 | 38% |
| 6C | Oleic Acid | Carboxylate surfactant | 1.00 (1.0) | 0.82 | 54% |
| 7C | Ethox ML-5 | Ethoxylated alcohol surfactant | 1.00 (1.0) | 0.76 | 58% |

C: Comparative

EXAMPLES 8-16

Kaolin beneficiation is carried out as described in Examples 1-7, except that, to the pH adjusted slurry, 2 kg/Ton of magnetite microparticles having various particle sizes are added, followed by the addition of 2 Kg/Ton of a commercially available collector (CYTEC S8881, Cytec Industries, Inc., 0.6 Kg/T on an active basis) as shown in Table 3. The CYTEC S8881 collector contains a compound of the formula (I).

The results shown in Table 3 demonstrate that the degree of separation generally increases as the particle size of the magnetite microparticles is decreased.

TABLE 3

| No. | Surface Area of Magnetite Microparticles ($m^2/g$) | Equivalent spherical diameter of Magnetite Microparticles (nm) | % $TiO_2$ | Degree of Separation |
|---|---|---|---|---|
| 8C | No magnetite microparticles No compound of formula (I) | N/A | 1.349 | 25% |
| 9 | 5.0 | 230 | 1.26 | 30% |
| 10 | 10.0 | 114 | 1.268 | 30% |
| 11 | 25.0 | 46 | 0.847 | 53% |
| 12 | 51.0 | 22 | 1.011 | 44% |
| 13 | 64.7 | 18 | 0.958 | 46% |
| 14 | 75.5 | 15.2 | 0.815 | 55% |
| 15 | 82.0 | 14 | 0.53 | 71% |
| 16 | 126.5 | 9.2 | 0.35 | 71% |

EXAMPLES 17-20

Ground Montana talc containing goethite as the main impurity is blunged in water using a cowls type blender (Inco Mill) with a 4" blade at a tip speed of 5-10 feet per second (FPS) to about 50% solids at a pH of about 10.5 using a dispersant blend of 5-6 Kg/Ton of sodium silicate to 1-2 Kg/T of 10% sodium hydroxide. The resulting slurry is screened through a 200 mesh screen and kept as a master batch.

About one Kg of a fraction from the master batch, on dry basis, is weighed out and transferred to a cowls-type conditioning mill. The slurry is agitated at 1100 rpm (tip speed of about 19 FPS). Magnetite microparticles having a BET surface area of 5.0 $m^2/g$ (average diameter 230 nm) are added to the slurry, followed by the addition of a commercially available collector (CYTEC 56493, Cytec Industries Inc.) at the dosages shown in Table 4. The CYTEC S6493 collector contains a compound of the formula (I). After the magnetic reagent is mixed in for ½ to 1 minute, the slip is conditioned through an Inco mill for about 5 minutes at 1750 RPM (30 FPS tip speed).

The conditioned slip is then reduced to 25% solids and processed through a commercially available high gradient magnetic separator (Cryofilter, Outokumpu Technologies, Jacksonville, Fla.) filled with a nominal matrix (60 μm. in diameter) at a feed rate corresponding to 10 T/Hr under 5.0 Tesla magnetic field. The slip is fed through the magnet for 1 minute and 25 seconds followed by washing cycle. The beneficiated product (non-magnetic portion) is collected, oven dried and the GE Brightness measured. Results are shown in Table 4.

The results shown in Table 4 demonstrate that talc beneficiated using a magnetic reagent that contains magnetic microparticles and a compound of the formula (I) (Examples 19 and 20) is significantly brighter than both the talc feed (Example 17C) and a sample of the talc feed that is subjected to magnetic separation without magnetic microparticles or a compound of the formula (I) (Example 18C).

TABLE 4

| No. | Magnetic Microparticles (Kg/T) | CYTEC S6493 Collector (Kg/T) | GE Brightness |
|---|---|---|---|
| 17C (Feed) | None | None | 85.5 |
| 18C (Magnetic Separation Only) | None | None | 87.4 |
| 19 | 0.125 | 0.125 | 89.4 |
| 20 | 0.25 | 0.25 | 88.2 |

EXAMPLES 21-23

Ground phosphate ore slurry at 70% solids is subjected to an initial high gradient magnetic separation treatment and then allowed to stand for 10 minutes to settle the coarse fraction. The fines are decanted to provide a master batch slurry having a solids level of 26.57%. A portion of the slurry is then screened through 325 mesh and about one kg of the fines fraction, on dry basis, is weighed out and transferred to a cowls-type conditioning mill. The slurry is agitated at 1750 RPM (tip speed about 30 FPS). Magnetite microparticles and a dispersant (AP908W from Alabama pigments, Alabama) are added, followed by the addition of a commercially available collector (CYTEC S8881, Cytec Industries Inc.) as shown in Table 5. The CYTEC S8881 collector contains a compound of the formula (I).

After the magnetic reagent is mixed in for ½ to 1 minute, the slip is conditioned through an Inco mill for 6 minutes at 1750 RPM (30 FPS tip speed). The conditioned slip is then processed through a commercially available high gradient magnetic separator (Cryofilter, Outokumpu Technologies, Jacksonville, Fla.) filled with a nominal matrix (60 μm. in diameter) at a feed rate corresponding to 10 T/Hr under 5.0 Tesla magnetic field. The slip is fed through the magnet for 1 minute and 25 seconds followed by a washing cycle. The beneficiated phosphate product (non-magnetic portion) is collected, oven dried and the iron, titanium and manganese content are measured.

The results shown in Table 5 demonstrate that phosphate beneficiated using a magnetic reagent that contains magnetic microparticles and a compound of the formula (I) (Example 23) contains significantly less Fe, Mn and Ti than both the phosphate feed (Example 21C) and a sample of the phosphate feed that is subjected to magnetic separation without magnetic microparticles or a compound of the formula (I) (Example 22C).

TABLE 5

| No. | Magnetite Microparticles (Kg/T) | CYTEC S8881 Collector (Kg/T) | Fe (%) | Mn (ppm) | Ti (ppm) |
|---|---|---|---|---|---|
| 21C (Feed) | None | None | 14.2 | 2572 | 2953 |
| 22C (Magnetic Separation Only) | None | None | 12.4 | 2718 | 2275 |
| 23 | 1.25 | 1.66 | 10.1 | 1952 | 1343 |

Example 24

This example demonstrates the use of a magnetic reagent pre-mix that contains magnetite microparticles and a compound of the formula (I) for the beneficiation of a mineral substrate (kaolin).

A magnetic reagent containing magnetite microparticles and a compound of the formula (I) is prepared as follows: 18.2 g (6.0 grams on dry basis) of an aqueous dispersion of magnetite microparticles having a BET surface area of 82.0 $m^2$/gm (average diameter 14 nm) is mixed with 21.7 g of water. About 0.1 g of a sodium silicate dispersant (Star Brand) is then added. The mixture is stirred with a homogenizer at low speed, then 8.00 grams of a commercially available collector (CYTEC Aero® 6494 collector, Cytec Industries Inc.) is added. The CYTEC Aero® 6494 collector contains a compound of the formula (I). The resulting magnetic reagent pre-mix is homogenized using the homogenizer at low speed setting.

Kaolin beneficiation is carried out as described in Examples 1-7, except that about 10.0 grams of the magnetic reagent pre-mix is added to the pH-adjusted slurry. The resulting beneficiated kaolin has a $TiO_2$ content of about 0.54% (degree of separation about 70%).

EXAMPLES 25-39

Crude kaolin characterized as "coarse white" or medium coarse white" or a blend thereof from middle Georgia with a $TiO_2$ level of 1.8% (by weight) is blunged in water to about 40-45% solids at pH=8 using a dispersant blend of 5-6 lbs/Ton of sodium silicate to 1-2 part sodium hydroxide. After degritting this crude through a Dorr-Cone, sandbox and 100 mesh screen, the crude is fractionated on a Bird Machine Co. (South Walpole, Mass.) centrifuge to obtain a fine fraction of 90% less than two microns as measured on a Sedigraph 5100 (Micromeritics, Norcross, Ga.). No further work is done on the coarse fraction. The fines are at 30.3% solids.

About one Kg of the fines fraction on dry basis is weighed out and transferred to a Kady conditioning mill. The slurry is agitated at low speed at 10-20 Hz frequency in the Kady mill and dosed with 2 Kg/T of a sodium silicate dispersant (Star Brand Silicate) on an as-received basis followed by adding 2 Kg/T of 10% NaOH solution to adjust the pH to 9.2. To the pH-adjusted slurry, 1 kg/Ton of magnetite microparticles having a BET surface area of 82.0 $m^2$/g (average diameter 14 nm) are added, followed by the addition of 1.33 Kg/T (on as is basis) of Cytec 56493.

After the additives are mixed in for about 30 seconds to 1 minute, the slip is conditioned through a Kady mill for 6 minutes at 60 Hz frequency from 38 to 57 HP-hours/ton. The conditioned slip is then reduced to 25% solids and processed through a high gradient magnetic separator (Cryofilter, Outokumpu Technologies, Jacksonville, Fla.) filled with a nominal matrix (35 μm. in diameter) at feed rates in the range of 11.5 TPH to 23.0 TPH under a varying magnetic field (flux) from 0.1 to 5.0 Tesla (1000 to 50000 Gauss). The slip is fed through the magnet for a stipulated period of time followed by a washing cycle. The product is collected, oven dried and the $TiO_2$ level in the beneficiated kaolin is measured (% $TiO_2$).

Table 6 shows that the highest degree of separation (68%) is obtained in using magnetite microparticles and a compound of the formula (I) independent of the magnetic flux or field in the range of 0.1-5.0 Tesla.

TABLE 6

| Example No. | Magnetic field | Feed Rate | % TiO2 in the product |
|---|---|---|---|
| 25 | 0.1 | 11.5 | 0.573 |
| 26 | 0.18 | 11.5 | 0.475 |
| 27 | 0.25 | 11.5 | 0.543 |
| 28 | 0.5 | 11.5 | 0.47 |
| 29 | 1 | 11.5 | 0.45 |
| 30 | 2.5 | 11.5 | 0.44 |
| 31 | 5 | 11.5 | 0.44 |
| 32 | 0.5 | 17.3 | 0.50 |
| 33 | 0.5 | 23 | 0.50 |
| 34 | 1 | 17.3 | 0.58 |
| 35 | 1 | 23 | 0.55 |
| 36 | 2.5 | 17.3 | 0.48 |
| 37 | 2.5 | 23 | 0.52 |
| 38 | 5 | 17.3 | 0.60 |
| 39 | 5 | 23 | 0.55 |

The products were reductively bleached by standard sodium dithionite at acidic pH and the GE brightness of all the products ranged between 90 and 91.5% using standard brightness meter.

It will be appreciated by those skilled in the art that various omissions, additions and modifications may be made to the materials and methods described above without departing from the scope of the invention, and all such modifications and changes are intended to fall within the scope of the invention, as defined by the appended claims.

What is claimed is:

1. A magnetic reagent for separating a value mineral from a non-value mineral, said reagent comprising:

a plurality of magnetite microparticles having an average diameter of less than 50 microns; and a compound of formula (I), $$R—(CONH—O—X)_n \quad (I)$$

wherein the compound of formula (I) has a molecular weight of about 2,000 or less;

n is an integer from 1 to 3;

each X is individually selected from the group consisting of H, M and $NR'_4$, wherein M is a metal ion; and each R' is individually selected from the group consisting of H, $C_1$-$C_{10}$ alkyl, $C_6$-$C_{10}$ aryl, and $C_7$-$C_{10}$ aralkyl;

R comprises from about 1 to about 50 carbons; and wherein the plurality of magnetite microparticles and the compound of formula (I) are present in a weight ratio of magnetite microparticles: compound of formula (I) from about 10:1 to about 1:10.

2. A magnetic reagent according to claim 1, wherein X is H.

3. A magnetic reagent according to claim 1 or claim 2, wherein the plurality of magnetite microparticles have an average diameter of less than 1 micron, less than 0.2 micron, or less than 0.02 micron.

4. A magnetic reagent according to claim 1 or claim 2, wherein R is chosen from $C_1$-$C_{20}$ alkyl, $C_6$-$C_{20}$ aryl, or $C_7$-$C_{20}$ aralkyl.

5. A magnetic reagent according to claim 4, wherein the plurality of magnetite microparticles have an average diameter of less than 1 micron, less than 0.2 micron, or less than 0.02 micron.

6. A magnetic reagent according to claim 1 further comprising a dispersant selected from the group consisting of a silicate, a phosphate, and a water-soluble polymer.

7. A magnetic reagent according to claim 6, wherein the dispersant is a silicate.

8. A magnetic reagent according to claim 6, wherein the dispersant is a water-soluble polymer that comprises at least one moiety selected from the group consisting of carboxyl and sulfonate.

9. A magnetic reagent according to claim 4, wherein R is chosen from a $C_4$-$C_{12}$ alkyl.

10. A magnetic reagent according to claim 9, wherein R is chosen from mixtures of $C_8$-$C_{12}$ alkyl.

11. A magnetic reagent according to claim 1, wherein the compound of formula (I) is chosen from one or more alkyl hydroxamate collector.

12. A magnetic reagent according to claim 11, wherein the plurality of magnetite microparticles have an average diameter of less than 1 micron, less than 0.2 micron, or less than 0.02 micron.

13. A magnetic reagent according to claim 11 further comprising a dispersant selected from the group consisting of a silicate, a phosphate, and a water-soluble polymer.

14. A magnetic reagent according to claim 13, wherein the dispersant is a silicate.

15. A magnetic reagent according to claim 13, wherein the dispersant is a water-soluble polymer that comprises at least one moiety selected from the group consisting of carboxyl and sulfonate.

* * * * *